United States Patent [19]

Masaki

[11] Patent Number: 4,800,329

[45] Date of Patent: Jan. 24, 1989

[54] DEVICE FOR LIMITING INRUSH CURRENT

[75] Inventor: Kazumi Masaki, Osaka, Japan

[73] Assignee: Ken Hayashibara, Okayama, Japan

[21] Appl. No.: 198,487

[22] Filed: May 23, 1988

Related U.S. Application Data

[63] Continuation of Ser. No. 1,625, Jan. 5, 1987, abandoned.

[30] Foreign Application Priority Data

Feb. 10, 1986 [JP] Japan ..... 61-27513

[51] Int. Cl.[4] ..... H02H 9/02

[52] U.S. Cl. ..... 323/242; 323/908; 315/DIG. 7; 363/53

[58] Field of Search ..... 323/237, 242, 300, 325, 323/326, 901, 908; 363/49, 50, 53, 85, 86, 126; 361/58, 111; 315/310, DIG. 5, DIG. 7

[56] References Cited

U.S. PATENT DOCUMENTS

| | | | |
|---|---|---|---|
| 3,793,581 | 2/1974 | Ortgies, Jr. | 323/325 |
| 4,207,516 | 6/1980 | Babcock | 323/908 X |
| 4,555,741 | 11/1985 | Masaki | 323/908 X |
| 4,654,579 | 3/1987 | Masaki | 323/242 X |

FOREIGN PATENT DOCUMENTS

| | | | |
|---|---|---|---|
| 2741186 | 6/1980 | Fed. Rep. of Germany . | |
| 0139048 | 10/1979 | Japan | 323/908 |
| WO84/00463 | 2/1984 | PCT Int'l Appl. . | |

OTHER PUBLICATIONS

M. Glasberg, "Silicon Controlled Rectifiers", Electromechanical Design, vol. 6, No. 3, pp. 13–16, 19, 22–26, Mar. 1962.

J. B. Davis et al., "Low-Voltage AC Hg Arc Lamp Power Supply", IBM Tech. Discl. Bulletin, vol. 18, No. 2 Jul. 1975, pp. 596–597.

*Primary Examiner*—Peter S. Wong

*Attorney, Agent, or Firm*—Browdy & Neimark

[57] ABSTRACT

Disclosed is a device for limiting the inrush current in a lamp, comprising a resistor means to limit the inrush current that may arise in a lamp, the resistor means being connected in series with the lamp and power source; a controlled rectifier (main controlled rectifier) having the main currrent path connected in parallel with the resistor means; another controlled rectifier (secondary controlled rectifier) having the main current path connected with the gate of the main controlled rectifier; and a delay circuit (e.g. RC-time constant circuit) having the output connected with the gate of the secondary controlled rectifier in such manner that the power source energizes the lamp through the resistor means over the time as predetermined by the time constant of the delay circuit.

7 Claims, 3 Drawing Sheets

DEVICE FOR LIMITING INRUSH CURRENT

This application is a continuation, of application Ser. No. 001,625, filed Jan. 5, 1987, now abandoned.

BACKGROUND OF THE INVENTION

1. Field of the invention

The present invention relates to a device to limit inrush current, specifically, to a device to limit the inrush current which may arise in lamp on its starting.

2. Description of the prior art

The resistance of a cold filament is, generally, one-tenth of that at the incandescent state. Energization of the rated voltage permits a high inrush current into the filament possibly to the damage of the filament and/or power source.

I discovered that such inrush current can be effectively limited with a device wherein a controlled rectifier, having a main current path connected in parallel with an inrush current limiting resistor, is connected in series with the lamp, and wherein the conduction of the controlled rectifier is controlled with a delay circuit in such manner that the power source energizes the lamp through the resistor over the time as predetermined by the time constant of the delay circuit, and disclosed this in Japanese Patent Laid-Open Nos. 215,697/84, 215,696/84 and 230,298/84.

Since in conventional device the triggering voltage of the controlled rectifier extremely varies with the change in junction temperature, for example, from 0.9 to 0.6 volts in the temperature range of −40° C. to +40° C., the operation point of the controlled rectifier is dependent on the ambient temperature, and, at a relatively high ambient temperature, the destruction by overheating may shorten the life of the controlled rectifier.

SUMMARY OF THE INVENTION

In view of the foregoing, I investigated means to stably control the controlled rectifier without causing overheating even when the ambient temperature extremely varies.

This and other objects as may become apparent hereinafter have been attained with the device comprising a resistor means to limit the inrush current that may arise in a lamp, the resistor means being connected in series with the lamp and power source; a controlled rectifier (main controlled rectifier) having the main current path connected in parallel with the resistor means; another controlled rectifier (secondary controlled rectifier) having the main current path connected with the gate of the main controlled rectifier; and a delay circuit having the output connected with the gate of the secondary controlled rectifier in such manner that the power source energizes the lamp through the resistor means over the time as predetermined by the time constant of the delay circuit.

DESCRIPTION OF THE PREFERRED EMBODIMENTS

The present invention will hereinafter be explained with reference to the accompanying drawings in which.

Throughout the accompanying drawings, symbol R designates resistor; C, capacitor; Z, Zener diode; S, switch; D, diode; SCR, controlled rectifier; and L, lamp.

Figure 1:
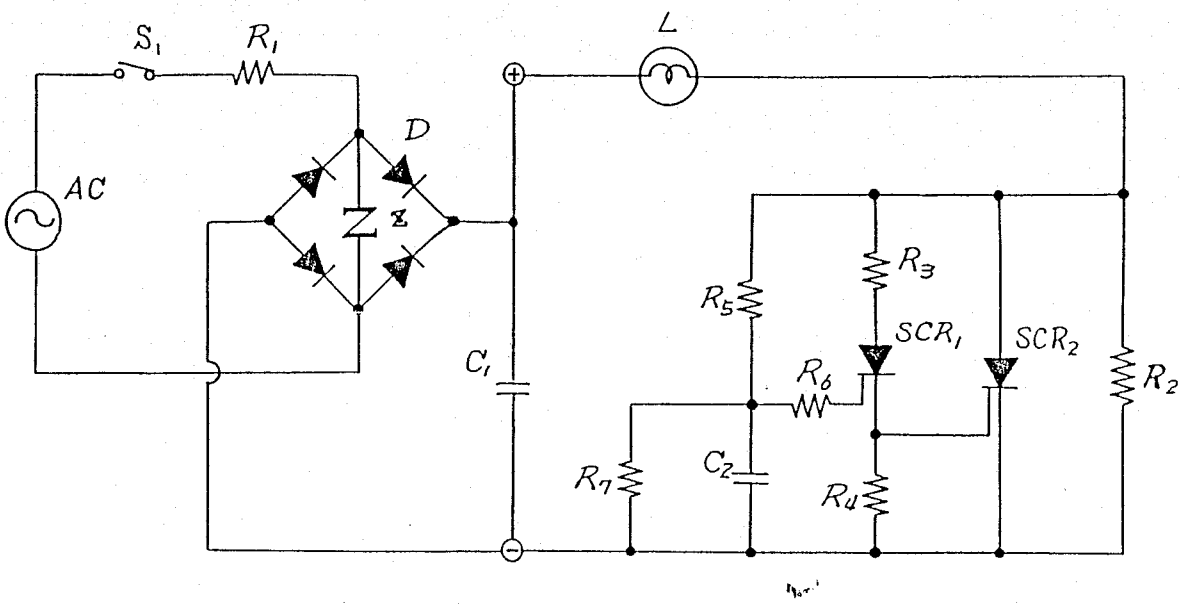
FIG. 1 is the circuit of an embodiment according to the invention.

In the circuit as shown in FIG. 1, to the output terminal of rectifier bridge D is connected in series lamp L and resistor $R_2$. Resistor $R_2$ is for limitation of inrush current and connected in parallel with main controlled rectifier $SCR_2$, while between the anode and gate of main controlled rectifier $SCR_2$ secondary controlled rectifier $SCR_1$that operates with a relatively small current is connected via resistor $R_3$. Resistor $R_5$ and capacitor $C_2$ form a delay circuit having a time constant, and, on closing of power switch $S_1$, the conduction of secondary controlled rectifier $SCR_1$ delays in accordance with the time constant. The filament of lamp L is preheated during the delay, and the resistance of the filament increases to the stationary level by the time when resistor $R_2$ will be short-circuited. The conduction current of secondary controlled rectifier $SCR_1$ instantly energizes main controlled rectifier $SCR_2$ to short-circuit resistor $R_2$. The output of rectifier bridge D is smoothed by capacitor $C_1$, and supplied to lamp L instantly on short-circuit of resistor $R_3$.

After conduction of main controlled rectifier $SCR_2$, the voltage across the controlled rectifier energizes the delay circuit to keep main- and secondary-controlled rectifiers $SCR_2$ and $SCR_1$ conductive.

Thus, the inrush current which may arise on the starting of lamp can be effectively limited.

In this embodiment, by setting the time constant to from 0.1 to 0.01 of a second with CRO2AM (a controlled rectifier having a rated voltage of 0.8 volts, rated current of 0.3 milliamperes, and averaged driving power of 0.24 milliwatts, as main controlled rectifier $SCR_2$), resistor $R_5$ (100 kiloohms), capacitor $C_2$ (220 microfarads) and resistor $R_7$ (10 kiloohms), the gate current of secondary controlled rectifier $SCR_1$ can be suppressed to 1 milliampere or less. Supposing that the gate current thermally varies to 50% increment, the maximum gate current is up to 2 milliamperes that never overheats the gate of main controlled rectifier $SCR_2$. In this case, the power consumption of the delay circuit is 0.17 watts (=130 volts×130 volts/100 kiloohms) which is extremely lower than that consumed by conventional device.

Figure 2:
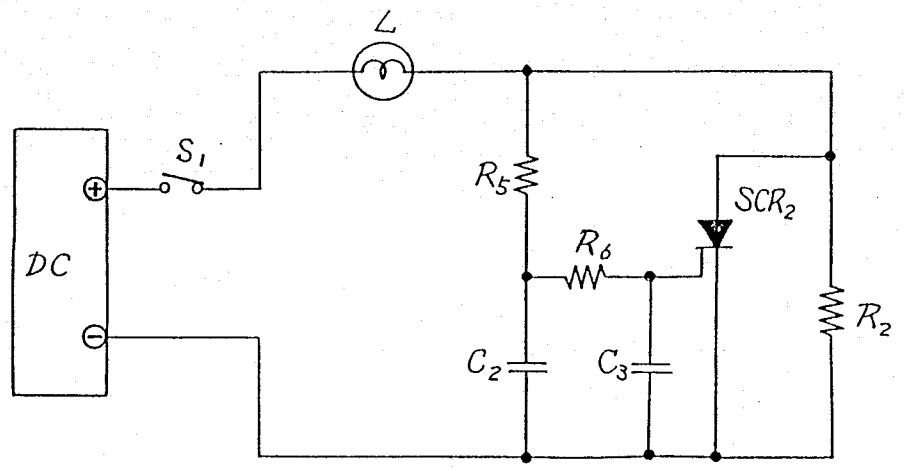
FIG. 2 is the circuit of the prior art.

More particularly, the time constant of a few one-tenth of a second can be obtained by omitting secondary controlled rectifier $SCR_1$ as shown in FIG. 2, and using resistors $R_5$ and $R_6$ (total resistance of 3 kiloohms) and capacitor $C_3$ (2,000 microfarads). Since this arrangement renders the operation of the controlled rectifier unstable when used in a cold environment, the total resistance of resistors $R_5$ and $R_6$ must be decreased to 2 kiloohms. For this reason, on closing of the power switch a current of 65 milliamperes (=130 volts/2 kiloohms) instantly flows, and the power consumption in the delay circuit is 8.45 watts (=65 milliamperes×130 volts). This is 50-fold higher than that of the present invention.

By transmitting the output of the delay circuit to the main controlled rectifier via the secondary controlled rectifier, the conduction of the main controlled rectifier can be stably controlled without causing overheating even as the triggering voltage of the main controlled rectifier varies with the ambient temperature. Thus, according to the invention a device directed for use in a cold environment can be stably used at a relatively high temperature.

In this embodiment, resistor $R_1$ connected at the ac side of rectifier bridge D is generally set to about 0.5 to 3 ohms to cause a loss to the arc discharge current which may arises on the outage of lamp L during dc illumination. This prevents a possible damage of the circuit elements such as diodes and controlled rectifiers.

Figure 3:
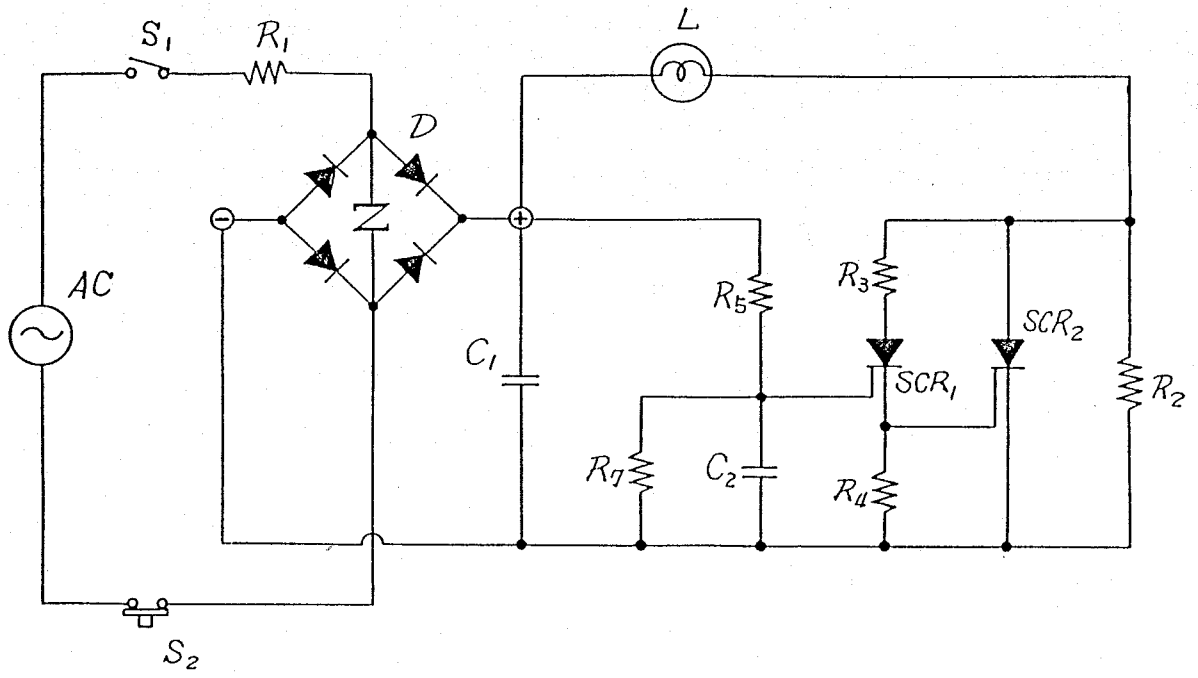
FIG. 3 is the circuit of another embodiment according to the invention.

FIG. 3 is illustrative of another embodiment according to the invention. In this embodiment, the positive output terminal of rectifier bridge D is used as the source to charge the delay circuit.

Similarly as in the preceding embodiment, this embodiment is arranged to cause a loss to the arc discharge current that may arise on the outage of lamp L during dc illumination by connecting low resistor $R_1$ in series with the ac side of rectifier bridge D in order to prevent a possible damage of the circuit elements such as diode and controlled rectifiers.

As described above, in the device according to the invention the inrush current into lamp can be limited without causing overheating the controlled rectifier even when the triggering voltage of the controlled rectifier may vary with the ambient temperature.

Additionally, in the device according to the invention, when the ambient temperature increases and the gate trigger voltage of the main controlled rectifier lowers, the conduction current of the secondary controlled rectifier never increases to a level that overheats the gate of the main controlled rectifier to cause its destruction.

Furthermore, since the device according to the invention is simple but very effective in the limitation of inrush current, the device can be advantageously used in illumination using incandescent lamp or power source therefor.

It is further understood by those skilled in the are that the foregoing descriptions are preferred embodiments of the disclosed device and that various changes and modifications may be made in the invention without departing from the spirit and scope thereof.

I claim:

1. A device for limiting inrush current comprising a rectifier circuit comprising a rectifier and smoothing means;

a first resistor means to limit the inrush current that may arise in a lamp, said resistor means being connected with a dc side of said rectifier circuit through said lamp;

a second resistor means to cause a loss to the arc discharge current that may arise in said lamp on its outage, said second resistor means being connected at an ac side of said rectifier circuit;

a main controlled rectifier having its main current path connected in parallel with said first resistor means;

a secondary controlled rectifier having its main current path connected with a gate of said main controlled rectifier; and a delay circuit having an output connected with a gate of said secondary controlled rectifier in such manner that said rectifier circuit energizes said lamp through said first resistor means over a time as predetermined by a time constant of said delay circuit.

2. The device of claim 1, wherein said main controlled rectifier and said secondary controlled rectifier are reverse-blocking thyristors.

3. The device of claim 1, wherein said lamp is an incandescent lamp.

4. The device of claim 1, wherein said power source is a dc power source.

5. The device of claim 1, wherein said delay circuit is an RC-time constant circuit.

6. The device of claim 1, wherein said secondary controlled rectifier has its main current path connected in parallel with the main current path of said main controlled rectifier.

7. A device for limiting inrush current comprising a rectifier circuit comprising a rectifier and smoothing means;

a first resistor means to limit the inrush current that may arise in a lamp, said resistor means being connected with a dc side of said rectifier circuit through said lamp;

a second resistor means to cause a loss to the arc discharge current that may arise in said lamp on its outage, said second resistor means being connected at an ac side of said rectifier circuit;

a main controlled rectifier having its main current path connected in parallel with said first resistor means;

a secondary controlled rectifier having its main current path connected with a gate of said main controlled rectifier; and a delay circuit having an output connected with a gate of said secondary controlled rectifier in such manner that said rectifier circuit energizes said lamp through said first resistor means over a time as predetermined by a time constant of said delay circuit;

said delay circuit having its output connected to said main controlled rectifier through said secondary controlled rectifier as a means to stably control said main controlled rectifier with minimal change in temperature of said main controlled rectifier whereby the conduction of said main controlled rectifier can be stably controlled without causing overheating even as a triggering voltage of said main controlled rectifier varies with ambient temperature.

* * * * *